United States Patent [19]

Massey, Jr. et al.

[11] 4,104,770

[45] Aug. 8, 1978

[54] YARN TREATING JET MOVING A ROTATING BAFFLE AND DEFLECTOR AT ITS OUTLET AND METHOD OF OPERATION THEREOF

[75] Inventors: William Moore Massey, Jr.; Theodos Sandukas, both of Hixson, Tenn.

[73] Assignee: E. I. Du Pont de Nemours and Company, Wilmington, Del.

[21] Appl. No.: 801,568

[22] Filed: May 31, 1977

[51] Int. Cl.[2] ..... D02G 1/16

[52] U.S. Cl. ..... 28/257; 28/273

[58] Field of Search ..... 28/254, 257, 271, 273

[56] References Cited

U.S. PATENT DOCUMENTS

| | | | |
|---|---|---|---|
| 3,783,596 | 1/1974 | Waldkirch | 28/272 X |
| 3,831,363 | 8/1974 | Pike | 28/271 |
| 3,881,231 | 5/1975 | Price et al. | 28/254 |
| 3,955,952 | 5/1976 | Drummond | 28/254 X |
| 4,041,583 | 8/1977 | Hart et al. | 28/254 |

FOREIGN PATENT DOCUMENTS

| | | | |
|---|---|---|---|
| 4,738,906 | 10/1972 | Japan | 28/257 |

*Primary Examiner*—Louis K. Rimrodt

[57] ABSTRACT

A yarn treating jet is modified to include a freely rotatable cylinder at the outlet end of the jet and a deflector positioned above the cylinder to divert air from the yarn path which passes below and partially around the cylinder. The cylinder is positioned such that air impinging on the cylinder causes it to rotate in a direction counter to the yarn traveling around the cylinder.

5 Claims, 2 Drawing Figures

YARN TREATING JET MOVING A ROTATING BAFFLE AND DEFLECTOR AT ITS OUTLET AND METHOD OF OPERATION THEREOF

BACKGROUND OF THE INVENTION

This invention relates to a method and apparatus for treating yarn with a pressured fluid in a jet. More particularly, it concerns a baffle and deflector arrangement at the outlet end of a yarn texturing jet.

Fluid jet processess are known for texturing or bulking yarn that employ both movable and fixed baffles positioned at various distances from the outlet end of the jet and at various angles to the yarn path to deflect yarn and fluid from a straight path as they leave the jet.

In making a yarn having crunodal loops, the texturing jet must forward the overfed yarn under sufficient tension to keep the yarn from wrapping on the feed rolls, and this tension is provided by the drag of the pressurized air which is moving much faster than the yarn. The air opens the yarn, whips the filaments about, forms loops in the filaments, then entangles them together into a structure which can retain the loops under the tensions which such yarns encounter when made into fabrics. The tension must be low at the jet exit to accumulate loops and form the entangled structure. Immediately thereafter, higher tension is desired to tighten the entangled structure and stabilize it.

In order that the yarn texture be uniform, the tension on the yarn should be as uniform as possible in the low tension zone near the jet exit and in the higher tension stabilizing zone between the jet exit and the yarn takeaway. If tensions in these zones vary, the texture will be non-uniform along the end of the yarn. It can be seen that, if the yarn oscillates between the two zones, the tensions in both are nonuniform. In the case of a high speed process where high pressure air is required to give sufficient loops and entanglement, it is particularly difficult to provide stable, uniform tensions of the desired degrees.

A baffle against which the air and yarn impinge is often provided at the jet exit to provide a stagnant air zone and to change the direction of yarn movement abruptly. Such baffles are especially necessary at high speeds and pressures. pressure. However, with known cylindrical baffle arrangements, the air divides around the baffle, and the portion of the air which follows the yarn continues to exert tension. Other portions of the air stream impinge on the yarn on the far side of the baffle and shake it so as to produce nonuniform texture.

In the present invention, the majority of the air follows the upper surface of a cylindrical baffle while the yarn moves around the lower surface of the baffle. The air stream exerts drag on the baffle so that if the baffle is a low-friction roller, it will rotate in a direction counter to the yarn movement. This rotation further reduces the tension in the yarn at the jet exit and increases the tension between the baffle and the yarn take-away. A deflector positioned above the baffle prevents the air stream from disturbing the yarn as it leaves the baffle on the far side.

SUMMARY OF THE INVENTION

In a yarn treating jet including a body having yarn inlet and outlet ends connected by a central bore along a central axis, means for introducing pressurized gas through a gas inlet into said bore between said ends to contact yarn passing through the jet, said yarn and said gas following a path from said outlet end of said jet, the improvement comprising a freely rotatable cylinder having an axis in a plane perpendicular to said central axis positioned a fixed distance from said yarn outlet end for engaging the yarn and gas exiting therefrom, said axis of said cylinder being positioned below said central axis, said yarn engaging said cylinder and passing below and partially around the cylinder and then in an upwardly direction in said path; and a deflector positioned above and in close proximity to said cylinder, said deflector diverting gas above said cylinder away from said yarn traveling in said upwardly direction in said path.

The method includes the steps of passing yarn through a jet for treatment with pressurized gas then forwarding the yarn by means of the gas from the jet outlet in a path, the improvement comprising forwarding said yarn in said path below, partially around, and engaging a freely rotating cylinder having an axis located below the central axis of the jet; and diverting pressurized gas flowing above the cylinder away from said path.

DETAILED DESCRIPTION OF THE PREFERRED EMBODIMENT

Figure 1:
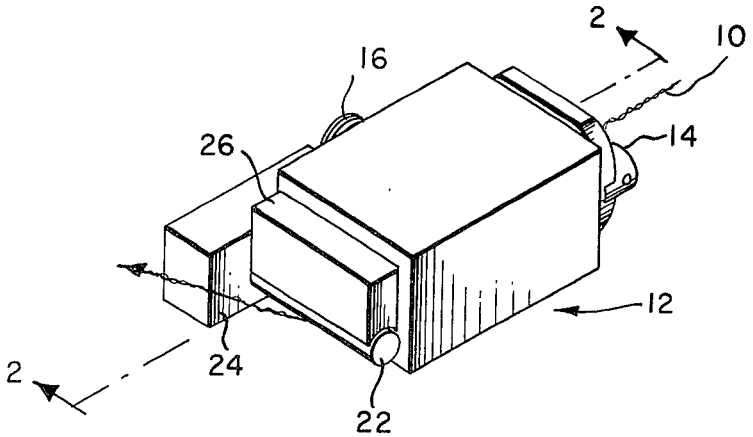
FIG. 1 is a perspective view of the jet apparatus used to practice the method of this invention.

In the drawing, yarn 10 enters a jet device 12 though yarn inlet 14. Compressed air or other pressurized gas enters the jet device 12 through pipe 16 and impinges on yarn 10 in the entrance 17 of yarn outlet orifice block 18. The yarn and high velocity gas travel together through outlet end 20 of the jet and strike cylinder 22 which is freely rotatable and mounted to bracket 24 attached to the outlet end of the jet.

Figure 2:
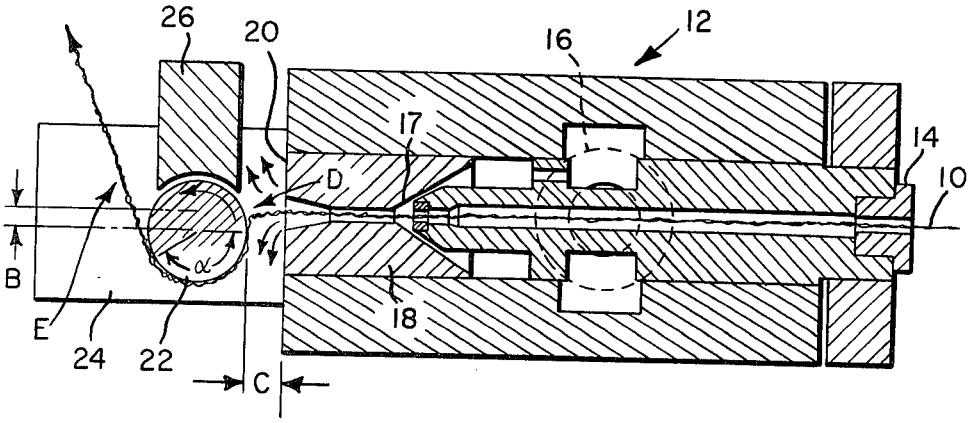
FIG. 2 is a sectioned view taken along line 2—2 of FIG. 1.

The central axis of cylinder 22 is contained in a plane which is perpendicular to the central axis of jet device 12 and is located below the central axis of the jet by a distance B as shown in FIG. 2. Preferably distance B is about 1/16 to about ¼ inch. The cylinder is also located a fixed distance C from the outlet end 20 of the jet. This distance C is preferably in the range of from about ¼ to about ¾ inch. The diameter of the cylinder 22 is selected so that the cylinder is large enough to contain the gas stream issuing from the jet outlet as shown by the gas flow arrows in FIG. 2. With the fixed distance in the range disclosed above, a diameter for cylinder 22 of about 1-⅜ inches has provided satisfactory operation when texturing yarn.

Also attached to bracket 24 is a vertically oriented deflector 26 located above and in close proximity to the cylinder.

In operation, yarn 10 is passed through jet 12 where it is treated with pressurized gas then propelled by the gas from the outlet end of the jet to impinge on cylinder 22 and travel partially around the lower surface of the cylinder then leave the cylinder in an upward direction. Preferably the yarn engages the cylinder 22 a circumferential distance encompassing an angle $\alpha$ of from about 120° to about 240°. Since the cylinder axis is below the central axis of the jet, most of the gas is diverted over the top of the cylinder and the drag of the impinging gas stream causes the cylinder to rotate in a direction counter to the motion of the yarn 10.

The rotation of the baffle counter to yarn movement reduces tension in the yarn at the yarn outlet end of the jet (zone D) and increases tension in the yarn line after it leaves the cylinder 22 (zone E).

The deflector 26 diverts the gas passing over the top of cylinder 22 away from the yarn path as it leaves cylinder 22 to minimize disturbance of the yarn and improve yarn line stability. This in turn permits higher yarn bulk at the same texturing speed, or the same yarn bulk at higher texturing speed without sacrificing other properties such as tension stability or bulk uniformity.

Although the illustrated embodiment shows deflector 26 to be vertically oriented, it can be oriented angularly with respect to the vertical direction and may include a curved deflecting surface as long as the deflector prevents the air from striking the yarn. Alternatively, the deflector may also be mounted by means other than a bracket 24 attached to the outlet end of the jet. For example, a separate mounting bracket attached to a frame for mounting the jet may be used.

What is claimed is:

1. In a yarn treating jet including a body having yarn inlet and outlet ends connected by a central bore along a central axis, means for introducing pressurized gas through a gas inlet into said bore between said ends to contact yarn passing through the jet, said yarn and said gas following a path from said outlet end of said jet, the improvement comprising: a freely rotatable cylinder having an axis in a plane perpendicular to said central axis positioned a fixed distance from said yarn outlet end for engaging the yarn and gas exiting therefrom, said axis of said cylinder being positioned below said central axis, said yarn engaging said cylinder and passing below and partially around the cylinder and then in an upwardly direction in said path; and a deflector positioned above and in close proximity to said cylinder, said deflector diverting gas above said cylinder away from said yarn traveling in said upwardly direction in said path.

2. The jet as defined in claim 1, said cylinder having a diameter sufficient to contain said gas exiting from said outlet at said fixed distance.

3. In a method that includes the steps of passing yarn through a jet for treatment with pressurized gas then forwarding the yarn by means of the gas from the jet outlet in a path, the improvement comprising: forwarding said yarn in said path below, partially around, then above, and engaging a freely rotating cylinder having an axis located below the jet outlet whereby the cylinder rotates counter to yarn movement; and deflecting pressurized gas flowing above the cylinder away from said path extending above said cylinder.

4. The method as defined in claim 3, said gas rotating said cylinder in the opposite direction to the yarn travel.

5. The method as defined in claim 3, said yarn engaging said cylinder for a circumferential distance encompassing an angle of from about 120° to about 240°.

* * * * *